US012492098B2

(12) United States Patent
Fu et al.

(10) Patent No.: US 12,492,098 B2
(45) Date of Patent: Dec. 9, 2025

(54) POSITION-ADJUSTABLE SPOOL RETURN-STOP DEVICE

(71) Applicant: ZHENGZHOU DEWENWILS NETWORK TECHNOLOGY CO., LTD., Henan (CN)

(72) Inventors: Yahui Fu, Henan (CN); Yuan Ren, Henan (CN); Naiyao Zhao, Henan (CN)

(73) Assignee: ZHENGZHOU DEWENWILS NETWORK TECHNOLOGY CO., LTD., Zhengzhou (CN)

( * ) Notice: Subject to any disclaimer, the term of this patent is extended or adjusted under 35 U.S.C. 154(b) by 103 days.

(21) Appl. No.: 18/607,818

(22) Filed: Mar. 18, 2024

(65) Prior Publication Data

US 2025/0243035 A1 Jul. 31, 2025

(30) Foreign Application Priority Data

Jan. 29, 2024 (CN) ..... 202420214895.8

(51) Int. Cl.
*B65H 75/44* (2006.01)

(52) U.S. Cl.
CPC ..... *B65H 75/4428* (2013.01)

(58) Field of Classification Search
CPC . B65H 75/44; B65H 75/4421; B65H 75/4428
See application file for complete search history.

(56) References Cited

U.S. PATENT DOCUMENTS 4,486,034 A * 12/1984 Sauer ..... F16L 33/227 285/242
9,051,947 B2 * 6/2015 Townsend, Jr. ..... F21V 21/008
11,365,086 B2 * 6/2022 Liu ..... B65H 75/4471
12,123,527 B2 * 10/2024 Cheng ..... E03C 1/04

FOREIGN PATENT DOCUMENTS

CN 1051236 A 5/1991
CN 103683118 A 3/2014

* cited by examiner

*Primary Examiner* — Sang K Kim

(57) ABSTRACT

The present disclosure relates to a position-adjustable spool return-stop device, including a first sleeve, a second sleeve, and a wire saddle, wherein the wire saddle has a cylindrical front end and a cone-shaped rear end; a through hole, through which a wire body can pass, is reserved in a middle of the wire saddle; a plurality of grooves are provided at the rear end of the wire saddle, which divide the rear end of the wire saddle into multiple petal bodies; the first sleeve and the second sleeve are sequentially sleeved outside the wire saddle from front to back, and the second sleeve is internally provided with a bundling hole; the inner diameter of the bundling hole gradually increases from front to back, and the wire saddle can move forward and backward along the bundling hole; and the wire saddle cannot rotate relative to the second sleeve.

7 Claims, 4 Drawing Sheets

POSITION-ADJUSTABLE SPOOL RETURN-STOP DEVICE

CROSS-REFERENCE TO RELATED APPLICATIONS

This application claims priority to Chinese Patent Application No. 202420214895.8, filed on Jan. 29, 2024, which is incorporated herein by reference in its entirety.

TECHNICAL FIELD

The present disclosure relates to the technical field of non-return balls, and more particularly relates to a position-adjustable spool return-stop device.

BACKGROUND

Spool retracting tools for wire reels, gas coils, water pipe reels, oil coils, and the like are all equipped with return-stop devices: the return-stop devices can prevent wires/pipes from being fully rewound into spools; and a user can leave a certain length of wire/pipe outside the spool by adjusting the position of the return-stop device on the wire/pipe, which is convenient for the user to use the wire at a fixed position.

At present, there are two types of return-stop device products. One type is a non-return ball that is fixed on a wire/pipe: the position of the non-return ball is fixed and cannot be adjusted after leaving the factory. The other type is a position-adjustable non-return ball product: when it is necessary to adjust the position of the non-return ball, a user needs to use a screwdriver tool to first unscrew set screws on the non-return ball, then place the non-return ball at an appropriate position and tighten the set screws. This adjustment method is cumbersome and time-consuming, and requires the use of tools.

SUMMARY

The technical problem to be solved by the present disclosure is to provide a position-adjustable spool return-stop device in response to the above shortcomings.

In order to solve the above technical problem, the present disclosure adopts the following technical solution:

A position-adjustable spool return-stop device includes a first sleeve, a second sleeve, and a wire saddle, where the wire saddle has a cylindrical front end and a cone-shaped rear end; a through hole, through which a wire body can pass, is reserved in a middle of the wire saddle; a plurality of grooves are provided at the rear end of the wire saddle, which divide the rear end of the wire saddle into multiple petal bodies; the first sleeve and the second sleeve are sequentially sleeved outside the wire saddle from front to back, the first sleeve and the wire saddle are assembled with threads, and the second sleeve is internally provided with a bundling hole; the inner diameter of the bundling hole gradually increases from front to back, and the wire saddle can move forward and backward along the bundling hole; and the wire saddle cannot rotate relative to the second sleeve.

Further, an annular groove is provided at a rear end of the first sleeve; and a protruding portion is provided at a front end of the second sleeve, a limiting protrusion is formed at an outer side of the protruding portion, and the limiting protrusion is matched with the annular groove.

Further, the protruding portion is cylindrical, and the limiting protrusion is annular.

Further, the cross-sectional shape of the limiting protrusion is a triangle-like shape.

Further, an external thread is formed at a front end of the outer side of the wire saddle, a plurality of strip-shaped threads are formed in a middle of the outer side of the wire saddle, the plurality of strip-shaped threads are distributed on the outer side of the wire saddle in the circumferential direction, the strip-shaped threads are formed axially, and the strip-shaped threads are connected to the external thread;

the first sleeve is internally provided with an internal thread, and the internal thread is matched with the external thread and the strip-shaped threads; and a plurality of chutes are provided on an inner side wall of the bundling hole, and the chutes are matched with the strip-shaped threads.

Further, anti-skid stripes are provided on outer sides of the first sleeve and the second sleeve.

Further, the first sleeve includes a first half sleeve and a second half sleeve, and the first half sleeve is detachably connected to the second half sleeve.

After adopting the above technical solution, the present disclosure has the following advantages compared with the prior art:

The present disclosure can allow the return-stop device to loosen a wire/pipe body by rotating the second sleeve so as to adjust the position of the return-stop device on the wire/pipe body, and then lock the return-stop device with the wire/pipe body by rotating the second sleeve in the opposite direction, making it convenient for users to adjust the position of the return-stop device quickly without using tools.

The present disclosure will be described in detail below with reference to the accompanying drawings and embodiments.

DETAILED DESCRIPTION OF THE EMBODIMENTS

Figure 1:
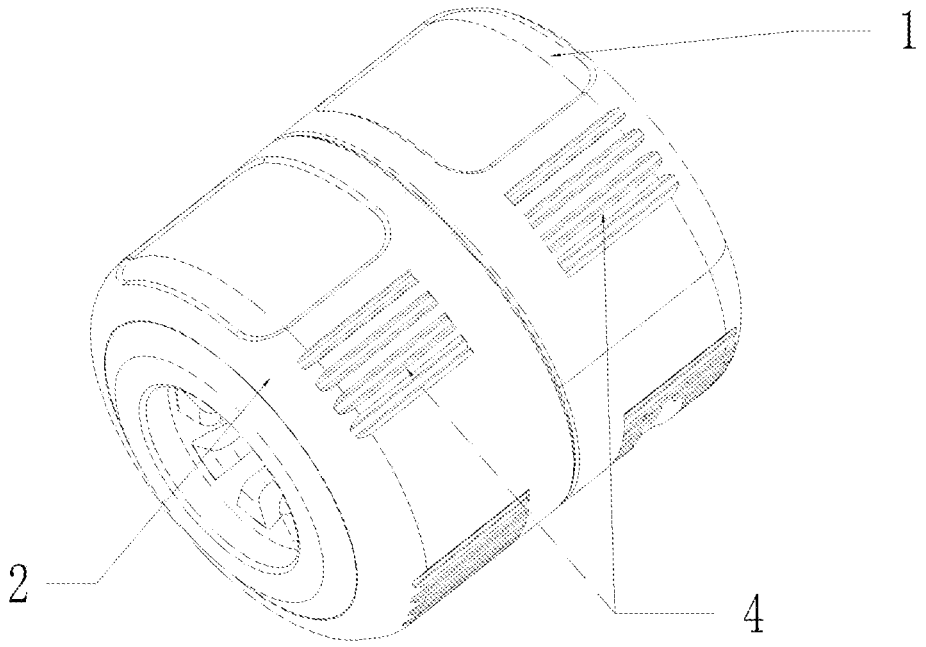
FIG. 1 is a schematic diagram of a three-dimensional structure of an embodiment of the present disclosure.

The principles and features of the present disclosure are described below in conjunction with the accompanying drawings, and the examples provided are only used to explain the present disclosure, not to limit the scope of the present disclosure.

In the description of the present disclosure, it should be noted that the orientations or positional relationships indicated by the terms "center", "upper", "lower", "left", "right", "vertical", "horizontal", "inner", "outer", "clockwise" and "counterclockwise" are based on the orientations or positional relationships shown in the drawings, which are only for the convenience of describing the present disclosure and simplifying the description, instead of indicating or implying that the device or component referred to must have a specific orientation, or be constructed and operated in a specific orientation, and therefore cannot be understood as a limitation on the present disclosure.

As shown in FIG. 1, FIG. 2, FIG. 3 and FIG. 4, a position-adjustable spool return-stop device includes a first sleeve 1, a second sleeve 2, and a wire saddle 3, where the wire saddle 3 has a cylindrical front end and a cone-shaped rear end; a through hole 31, through which a wire body can pass, is reserved in a middle of the wire saddle 3; a plurality of grooves 32 are provided at the rear end of the wire saddle 3, which divide the rear end of the wire saddle 3 into multiple petal bodies 3*a*; the first sleeve 1 and the second sleeve 2 are sequentially sleeved outside the wire saddle 3 from front to back, the first sleeve 1 and the wire saddle 3 are assembled with threads, and the second sleeve 2 is internally provided with a bundling hole 21; the inner diameter of the bundling hole 21 gradually increases from front to back, and the wire saddle 3 can move forward and backward along the bundling hole 21; and the wire saddle 3 cannot rotate relative to the second sleeve 2.

When the position of the return-stop device on a wire/pipe needs to be adjusted, the first sleeve 1 is rotated, and the rear end of the wire saddle 3 is driven to move backward in the bundling hole 21 through the thread fit between the first sleeve 1 and the wire saddle 3, so that all the petal bodies 3*a* are enabled to open outward and thus increase the inner diameter of a rear end of the through hole 31, which allows the wire saddle 3 to loosen the wire/pipe, then the return-stop device is enabled to move on the wire/pipe, and the position of the return-stop device can be adjusted accordingly; and after the return-stop device moves to the corresponding position, the first sleeve 1 is reversely rotated, and the rear end of the wire saddle 3 is driven to move forward in the bundling hole 21 through the thread fit between the first sleeve 1 and the wire saddle 3, so that all the petal bodies 3*a* are enabled to move towards the center and thus decrease the inner diameter of the rear end of the through hole 31, which allows the wire saddle 3 to be locked to the wire/pipe.

Preferably, anti-skid stripes 4 are provided on outer sides of the first sleeve 1 and the second sleeve 2.

The fitting diameter of the return-stop device is related to the inner diameter of the through hole 31, the maximum and minimum inner diameters of the bundling hole 21, and the maximum and minimum opening degrees of the petal bodies 3*a*.

Embodiment 1

This embodiment has an improvement in the structure of the first sleeve 1 and the second sleeve 2.

Figure 2:
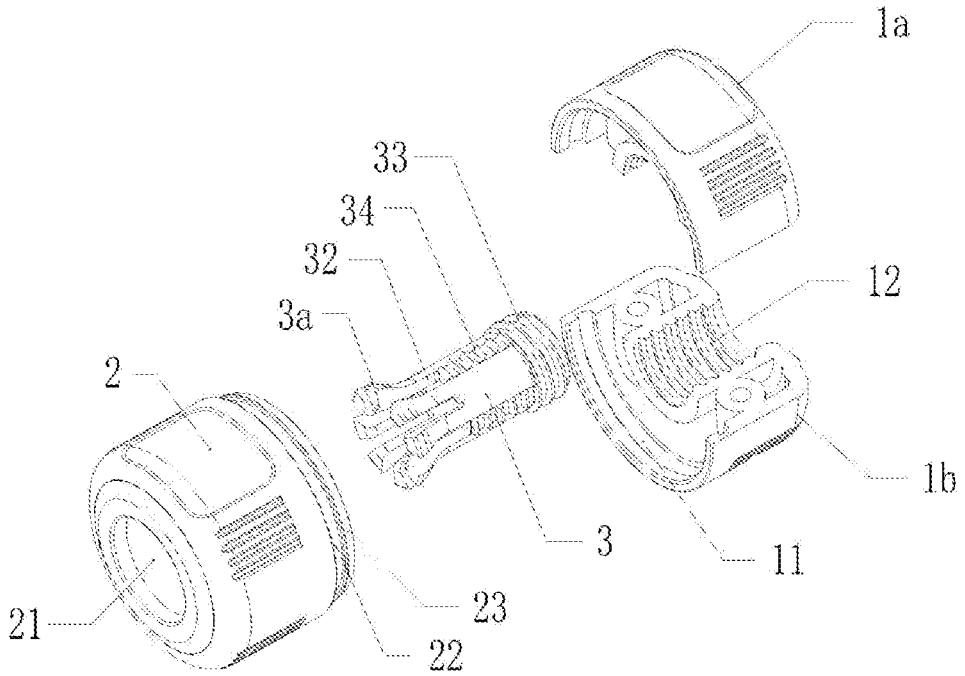
FIG. 2 is an exploded view of an embodiment of the present disclosure.
Figure 3:
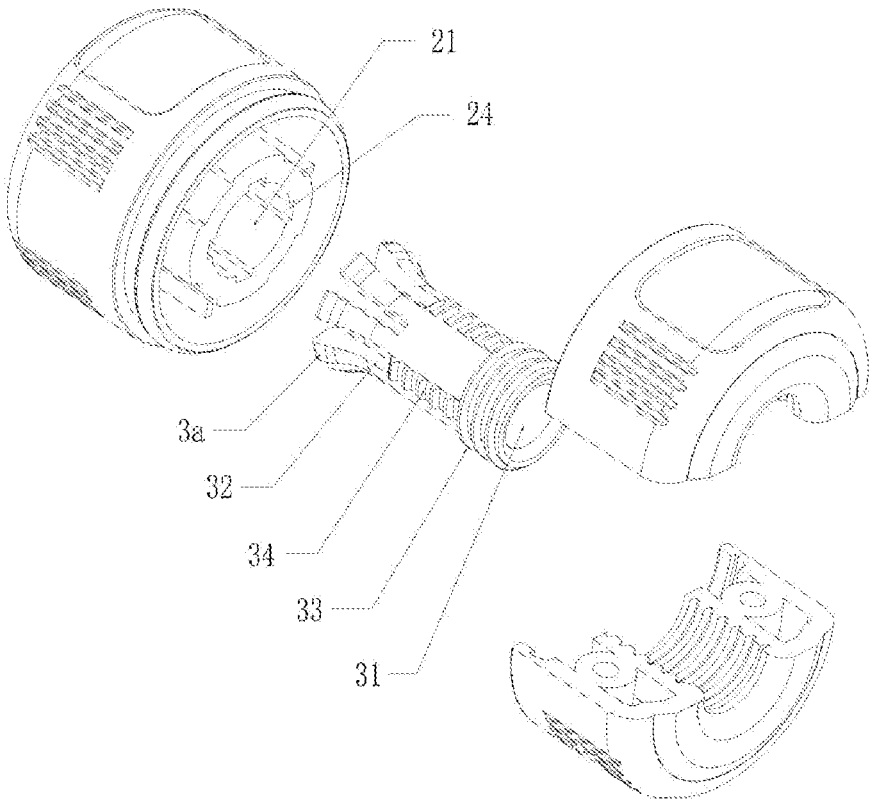
FIG. 3 is an exploded view from another perspective of an embodiment of the present disclosure.
Figure 4:
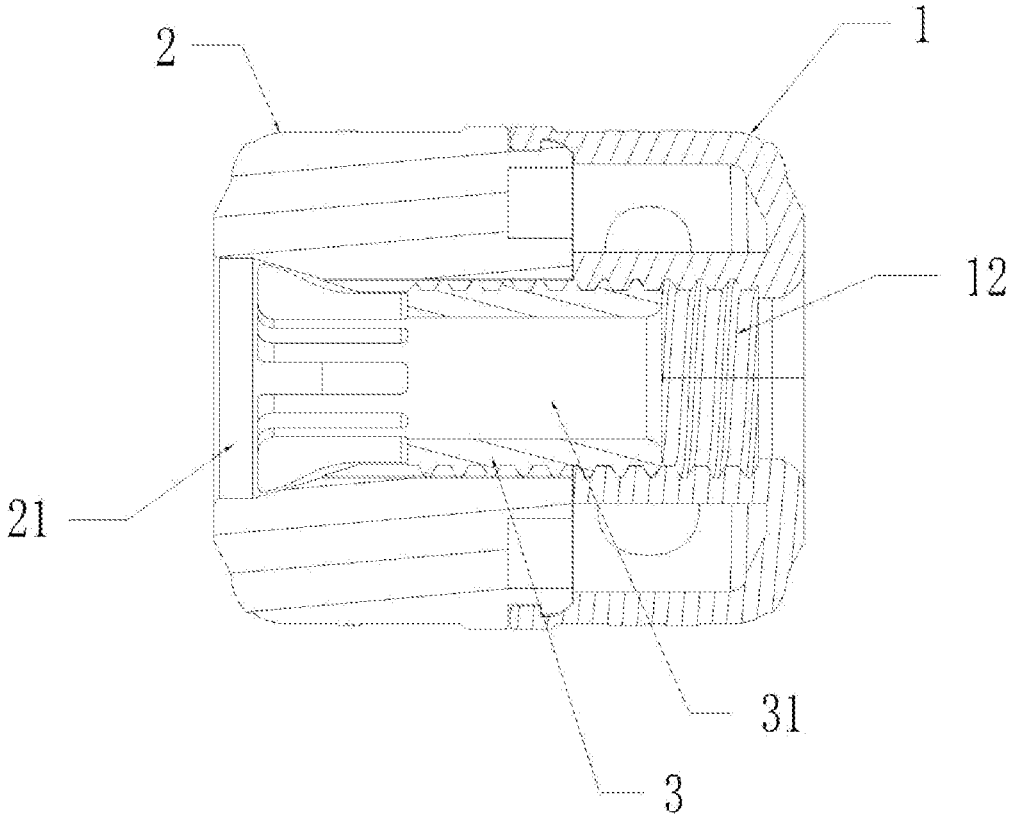
FIG. 4 is a cross-sectional view of an embodiment of the present disclosure.

As shown in FIG. 2 and FIG. 3, an annular groove 11 is provided at a rear end of the first sleeve 1; a protruding portion 22 is provided at a front end of the second sleeve 2, a limiting protrusion 23 is formed at an outer side of the protruding portion 22, and the limiting protrusion 23 is matched with the annular groove 11; and the first sleeve 1 is rotatably connected to the second sleeve 2 through the matching between the annular groove 11 and the limiting protrusion 23, and the first sleeve 1 will not be separated from the second sleeve 2.

Preferably, the protruding portion 22 is cylindrical, and the limiting protrusion 23 is annular.

Preferably, the cross-sectional shape of the limiting protrusion 23 is a triangle-like shape.

In order to facilitate the installation of the first sleeve 1 and the second sleeve 2, the first sleeve 1 includes a first half sleeve 1*a* and a second half sleeve 1*b*, and the first half sleeve 1*a* is detachably connected to the second half sleeve 1*b*. In this embodiment, the first half sleeve 1*a* is fixedly connected to the second half sleeve 1*b* by screws.

Embodiment 2

This embodiment has an improvement in the threaded structure of the wire saddle 3.

As shown in FIG. 2 and FIG. 3, an external thread 33 is formed at a front end of the outer side of the wire saddle 3, a plurality of strip-shaped threads 34 are formed in a middle of the outer side of the wire saddle 3, the plurality of strip-shaped threads 34 are distributed on the outer side of the wire saddle 3 in the circumferential direction, the strip-shaped threads 34 are formed axially, and the strip-shaped threads 34 are connected to the external thread 33; the thread parameters of the strip-shaped threads 34 are the same as those of the external thread 33; there are the four strip-shaped threads 34, which are evenly distributed on the outer side of the wire saddle 3;

the first sleeve 1 is internally provided with an internal thread 12, and the internal thread 12 is matched with the external thread 33 and the strip-shaped threads 34; and a plurality of chutes 24 are provided on an inner side wall of the bundling hole 21, and the chutes 24 are matched with the strip-shaped threads 34. Through the matching between the strip-shaped threads 34 and the chutes 24, the wire saddle 3 and the second sleeve 2 cannot rotate relative to each other, without affecting the forward and backward movement of the wire saddle 3 within the bundling hole 21.

The above descriptions are examples of the best embodiments of the present disclosure, and the parts not described in detail are common general knowledge known by those skilled in the art. The scope of protection of the present disclosure is subject to the content of the claims, and any equivalent variation based on the technical enlightenment of the present disclosure still fall within the scope of protection of the present disclosure.

What is claimed is:

1. A position-adjustable spool return-stop device, comprising a first sleeve, a second sleeve, and a wire saddle, wherein the wire saddle has a cylindrical front end and a cone-shaped rear end; a through hole, through which a wire body can pass, is reserved in a middle of the wire saddle; a plurality of grooves are provided at a rear end of the wire saddle, which divide the rear end of the wire saddle into multiple petal bodies; the first sleeve and the second sleeve are sequentially sleeved outside the wire saddle from front to back, the first sleeve and the wire saddle are assembled with threads, and the second sleeve is internally provided with a bundling hole; an inner diameter of the bundling hole gradually increases from front to back, and the wire saddle can move forward and backward along the bundling hole; and the wire saddle cannot rotate relative to the second sleeve.

2. The position-adjustable spool return-stop device according to claim 1, wherein an annular groove is provided at a rear end of the first sleeve; and a protruding portion is provided at a front end of the second sleeve, a limiting protrusion is formed at an outer side of the protruding portion, and the limiting protrusion is matched with the annular groove.

3. The position-adjustable spool return-stop device according to claim 2, wherein the protruding portion is cylindrical, and the limiting protrusion is annular.

4. The position-adjustable spool return-stop device according to claim 3, wherein a cross-sectional shape of the limiting protrusion is a triangle-like shape.

5. The position-adjustable spool return-stop device according to claim 1, wherein an external thread is formed at a front end of an outer side of the wire saddle, a plurality of strip-shaped threads are formed in a middle of the outer side of the wire saddle, the plurality of strip-shaped threads are distributed on the outer side of the wire saddle in the circumferential direction, the strip-shaped threads are formed axially, and the strip-shaped threads are connected to the external thread;

the first sleeve is internally provided with an internal thread (12), and the internal thread is matched with the external thread and the strip-shaped threads; and a plurality of chutes are provided on an inner side wall of the bundling hole, and the chutes are matched with the strip-shaped threads.

6. The position-adjustable spool return-stop device according to claim 1, wherein anti-skid stripes are provided on outer sides of the first sleeve and the second sleeve.

7. The position-adjustable spool return-stop device according to claim 1, wherein the first sleeve comprises a first half sleeve and a second half sleeve, and the first half sleeve is detachably connected to the second half sleeve.

* * * * *